US005710556A

United States Patent [19]

Nishimura et al.

[11] Patent Number: 5,710,556

[45] Date of Patent: Jan. 20, 1998

[54] DEVICE FOR LOCATING A MOVING BODY HAVING A RESPONSE UNIT

[75] Inventors: Yoshihiro Nishimura; Iwao Tanahashi; Kazumasa Nakamura; Kouichi Yagi, all of Aichi-ken, Japan

[73] Assignees: Kabushiki Kaisha Toyota Chuo Kenkyusho, Aichi-ken; Toyota Jidosha Kabushiki Kaisha, Toyota, both of Japan

[21] Appl. No.: 559,093

[22] Filed: Nov. 16, 1995

[30] Foreign Application Priority Data

Nov. 18, 1994 [JP] Japan ..... 6-284722

[51] Int. Cl.[6] ..... G08G 1/00; G08G 1/065

[52] U.S. Cl. ..... 340/928; 340/933; 340/825.31; 342/42

[58] Field of Search ..... 340/928, 933, 340/825.31; 342/42, 44

[56] References Cited

U.S. PATENT DOCUMENTS

| | | | |
|---|---|---|---|
| 4,887,080 | 12/1989 | Gross | 340/937 |
| 4,968,979 | 11/1990 | Mizuno et al. | 340/933 |
| 5,128,669 | 7/1992 | Dadds et al. | 342/42 |
| 5,204,675 | 4/1993 | Sekine | 340/928 |
| 5,351,052 | 9/1994 | D'Hont et al. | 342/42 |
| 5,406,275 | 4/1995 | Hassett et al. | 340/928 |
| 5,422,473 | 6/1995 | Kamata | 340/928 |
| 5,451,758 | 9/1995 | Jesadanont | 340/928 |
| 5,485,520 | 1/1996 | Chaum et al. | 340/825.31 |

FOREIGN PATENT DOCUMENTS

| | | |
|---|---|---|
| 0 300 200 | 1/1989 | European Pat. Off. . |
| 0 578 060 | 1/1994 | European Pat. Off. . |
| 0 585 718 | 3/1994 | European Pat. Off. . |
| 0 616 302 | 9/1994 | European Pat. Off. . |
| 41 28 312 | 3/1993 | Germany . |
| 2-93390 | 4/1990 | Japan . |
| 6-13933 | 1/1994 | Japan . |
| 2 027 312 | 2/1980 | United Kingdom . |
| WO 94/00830 | 1/1994 | WIPO . |

OTHER PUBLICATIONS

Mr. D P van Wijk, "Automatic Debiting in a Multilane Environment", 26th International Symposium on Automotive Technology and Automation, 93AT122, pp. 83–89.

Felix Dobias, et al., "Adaptive Array Antennas for 5.8 GHZ Vehicle to Roadside Communication", IEEE VTC 1994 Proceedings, vol. 3 pp. 1512–1516.

*Primary Examiner*—Jeffery Hofsass
*Assistant Examiner*—John Tweel, Jr.
*Attorney, Agent, or Firm*—Oblon, Spivak, McClelland, Maier & Neustadt, P.C.

[57] ABSTRACT

A device for locating a moving body includes:

an interrogation unit (10) for communicating with a response unit (50) mounted on a vehicle (51) present in a lane of a communication zone "a"; receiving antennas (21, 22) having receiving areas "**21*b*, 22*b*" divided in the width direction of the lane; and a processor (40) for determining the position of the vehicle in the communication zone based on a reception result from the receiving antennas. The device may also include a detecting device such as an imaging device (30) having an imaging area "c" of a size equal to the lane. This makes it possible to recognize an unauthorized vehicle (52) not having a response unit and thus passing through the imaging area "c" without a radio signal to be received by the receiving antennas (21, 22**).

20 Claims, 9 Drawing Sheets

DEVICE FOR LOCATING A MOVING BODY HAVING A RESPONSE UNIT

BACKGROUND OF THE INVENTION

1. Field of the Invention

This invention relates to a device for locating a moving body, such as a vehicle, a container or a human body, which has a response unit, and also to a device which, by communicating with a passing vehicle at a debiting station on a toll road, identifies a passing vehicle not equipped with a response unit.

2. Description of the Related Art

The use of mobile communications such as car telephones is steadily becoming more widespread. Mobile communications permit exchange of information without any physical contact with a moving body, and its use has been considered for the purpose of acquiring information about traffic jams or the destinations of vehicles, etc.

For example, in Japanese Patent Laid-open No. Hei 6-13933 (Conventional Example 1), an identifying device is disclosed for identifying the position of an unmanned transport vehicle. In this device, a relatively simple response unit, known as a tag unit, is installed on the moving body, and various information is exchanged with a fixed interrogation unit. This device comprises a plurality of communications units in order to cover a wide communication zone and deal simultaneously with a large number of passing vehicles. However, when a plurality of interrogation units are installed, their communication zones overlap. The carrier waves of adjacent interrogation units are therefore arranged to have different frequencies so as to prevent interference. In this way, the moving bodies can be separately distinguished from one another by the interrogation units which can communicate with the response units.

In IEEE VTC '94 PROCEEDINGS, Vol. 3, pp. 1512–1516 (Conventional Example 2), a method is proposed wherein the question unit has directionality in order to narrow the communication zone, and an antenna with a directional beam which has a narrow communication zone is used to cover a wide communication zone. In this device, the position of the response unit is the scanning position of the directional beam when communication is established, hence this method also enables moving bodies to be individually distinguished.

These conventional systems are therefore able to individually recognize moving bodies and communicate with them. The use of a mobile communications system has been proposed for fee collection on toll roads. In such a system, desired information (vehicle information, driver information, fees, etc.), is exchanged by radio between an interrogation unit that functions as a toll gate installed at a fixed position, and a response unit mounted on a vehicle. The fee may be collected by bank debit, for example, when the vehicle passes the gate, there being no need for the vehicle to stop. This saves time and trouble for both the driver and the road supervisor, and prevents traffic jams from building up at toll stations.

However, in the aforesaid first conventional example, the interrogation units have to simultaneously communicate with and identify a large number of response units. It is therefore necessary that the interrogation units do not interfere with one another, hence the overall system occupies a large frequency bandwidth and a large-scale circuit is required to make suitable provision for this.

In the aforesaid second conventional example, since there is only one interrogation unit there is no need for such a wide frequency bandwidth and the problem of interference is eliminated, but the communication zone of the interrogation unit is narrow. This means that data transmission must be performed at high speed so that it can be completed while the vehicle is in the communication zone of the interrogation unit. As a result the frequency bandwidth of the interrogation unit has to be broader. Alternatively, if the data transmission speed is not increased, the communication is not completed while the vehicle is in the communication zone. In the latter case, complicated control is required where scans are switched over according to the movement of the vehicle (response unit).

In particular, in the case of an automatic toll debiting system, when groups of motorcycles or large numbers of vehicles pass the toll station simultaneously, a clear distinction must be made between vehicles with which it is possible to establish communication and unauthorized vehicles with which it is not possible to do so. In the aforesaid examples, however, it was difficult to identify unauthorized vehicles carrying no or an inoperative response unit.

SUMMARY OF THE INVENTION

This invention, which was conceived in view of the aforesaid problems, aims to locate vehicles carrying a response unit without causing radio interference between interrogation units, and to identify unauthorized vehicles that pass by without communicating.

A device according to one aspect of this invention comprises an interrogation unit having a predetermined communication zone, said interrogation unit transmitting a radio signal to said communication zone where a moving body having a response unit for receiving said radio signal passes, a receiving device having a plurality of receiving areas at least in the width direction of a travel path of said moving body so as to cover said communication zone, said device being capable of receiving distinguishably each signal form said plurality of receiving areas, and processor for determining the position of said moving body in said communication zone based on a reception result of said receiving device.

When a moving body having the response unit enters the communication zone, the receiving device sends a radio signal to the response unit, and when the response unit receives this signal from the interrogation unit.

A receiving device receives a response signal from a response unit. The receiving device corresponding to a receiving area in which a response unit is located can receive the response signal. The position of the moving body can therefore be identified. According to this aspect of the invention, a whole travel path at least in the width direction of the moving body is covered by one communication zone and the receiving device can catch distinguishably each signal from the plurality of the receiving areas covering the communication zone. This enables to determine the position of the moving body without complicated control of scanning in accordance with the movement of the moving body.

Another aspect of the invention further comprises a detecting device for detecting the moving body when it enters the communication zone, thereby locating a plurality of said moving bodies in said communication zone based on a detection result thereof and the reception result of said receiving device, and or recognizing the existence of an unauthorized moving body without a proper response unit based on the detection result thereof and based on non-existence of the reception result of said receiving device.

In the case using a device that detects the position of a moving body in at least two dimensions, for example a radar device, imaging device or laser range finder, the detecting device, can detect the moving body and its position when it enters the communication zone. If the position of the detected moving body overlaps with the receiving area of the receiving device, and the moving body on which the response unit is mounted is photographed in the communication area, it is determined that the moving body is a moving body with which communication has been established (communicating moving body). Conversely, a moving body which has passed by without being identified as a communicating moving body although detected by the detecting device, is determined to be an unauthorized moving body. In this way, unauthorized moving bodies can be identified from the data output by the detecting means.

If a radar device is used as the detecting device, the transmitter of this radar device may be used as the aforementioned interrogation unit, and the response device responds to a signal transmitted by the radar device.

Another aspect of the invention the interrogation unit further comprises a device of receiving a radio signal from said moving body, and on both processor determines the position of said moving body based on both the reception result of said receiving device and a communication result i said interrogation unit.

A communication occurs between an interrogation unit and a response unit when a moving body on which a response unit capable of communication is mounted, enters the communication zone of the interrogation unit. For example, in the case of a passive response unit wherein two-way data transmission is performed using only a signal received from the interrogation unit, the interrogation unit repeatedly transmits a start-up signal and a subsequent unmodulated CW (Continuous Wave). When the response unit receives the start-up signal from the interrogation unit, it modulates the CW wave with its own data, and this is reflected to the interrogation unit as a start-up response signal. Communication between the interrogation unit and response unit is thereby established, and data exchange takes place between the interrogation unit and response unit.

In an active system where the response unit does have a transmitting function, when a moving body, the response unit that has received a start-up signal from the interrogation unit modulates its own carrier wave with data, as in the passive system. Also, as the response unit itself can emit continuously transmit request signal even before entering the communication zone, with two-way data communication taking place with the interrogation unit after the interrogation unit receives this request signal when the response unit enters the communication.

The detecting means constantly detects moving bodies that enter the communication zone of the interrogation unit. If a detected image overlaps with the receiving area of the receiving device which has received and demodulated data, and a moving body in the receiving area on which the response unit is mounted has been photographed, it is determined that the moving body is a vehicle with which communication has been established. Conversely, a vehicle, which has passed by without being identified as a communicating vehicle, although detected as an image, is determined to be an unauthorized vehicle. In this way, unauthorized vehicles can be identified from the image data.

According to another aspect of the invention, the detecting means is an imaging device for photographing a moving body, the processor comprises comparison circuit that compares data received by the receiving device with data received by the interrogation unit in order to locate the receiving area where the response unit exists, and the processing circuit that determines whether or not the moving body is carrying a proper response unit based on a signal output by the comparator and the image signal from the imaging device.

The data received by the receiving device is compared with data received by the interrogation unit, a receiving area is identified, and a moving body is identified. The moving body can therefore be identified with a high degree of certainty.

According to another aspect of the invention, the receiving device comprises a plurality of receiving devices respectively corresponding to the aforesaid plurality of receiving areas.

Receiving antennas are provided corresponding to a plurality of receiving areas. The entry position of a moving body can therefore be determined with a high degree of certainty depending on the nature of the signals received by the antennas.

According to another aspect of the invention, the receiving means comprises a beam control antenna that permits the orientation of a directional beam to be directed to each receiving area.

A plurality of receiving areas can be covered by one receiving devices using beam control. A small number of antennas is therefore sufficient.

According to another aspect of the invention, the receiving area of the receiving antenna is arranged to be wider at the entry point of the moving body than the communication zone of the transmitter or the interrogation unit.

The receiving area of a receiving device is arranged to be wider at the entry point of a moving body than the communication zone of the interrogation unit. The area which the moving body enters forming part of the communication zone of interrogation unit is covered by the receiving area. Hence, the receiving device can definitely catch communication between the response unit and interrogation unit even when the speed of the moving body is very slow in the vicinity of the front edge of the communication zone from which the moving body enters (e.g. when the moving body is trapped in a traffic jam), and the position of the response unit can therefore be identified.

When a moving body having the response unit enters the communication zone, the receiving device sends a radio signal to the response unit, and when the response unit receives this signal from the interrogation unit.

A receiving device receives a response signal from a response unit. The receiving device corresponding to a receiving area in which a response unit is located can receive the response signal. The position of the moving body can therefore be identified. According to this aspect of the invention, a whole travel path at least in the width direction of the moving body is covered by one communication zone and the receiving device can catch distinguishably each signal from the plurality of the receiving areas covering the communication zone. This enables to determine the position of the moving body without complicated control of scanning in accordance with the movement of the moving body.

In the case using a device that detects the position of a moving body in at least two dimensions, for example a radar device, imaging device or laser range finder, the detecting device, can detect the moving body and its position when it enters the communication zone. If the position of the detected moving body overlaps with the receiving area of the receiving device, and the moving body on which the response unit is mounted is photographed in the communication area, it is determined that the moving body is a moving body with which communication has been established (communicating moving body). Conversely, a moving body which has passed by without being identified as a communicating moving body although detected by the detecting device, is determined to be an unauthorized moving body. In this way, unauthorized moving bodies can be identified from the data output by the detecting means.

If a radar device is used as the detecting device, the transmitter of this radar device may be used as the aforementioned interrogation unit, and the response device responds to a signal transmitted by the radar device.

A communication occurs between an interrogation unit and a response unit when a moving body on which a response unit capable of communication is mounted, enters the communication zone of the interrogation unit. For example, in the case of a passive response unit wherein two-way data transmission is performed using only a signal received from the interrogation unit, the interrogation unit repeatedly transmits a start-up signal and a subsequent unmodulated CW (Continuous Wave). When the response unit receives the start-up signal from the interrogation unit, it modulates the CW wave with its own data, and this is reflected to the interrogation unit as a start-up response signal. Communication between the interrogation unit and response unit is thereby established, and data exchange takes place between the interrogation unit and response unit.

In an active system where the response unit does have a transmitting function, when a moving body, the response unit that has received a start-up signal from the interrogation unit modulates its own carrier wave with data, as in the passive system. Also, as the response unit itself can emit continuously transmit request signal even before entering the communication zone, with two-way data communication taking place with the interrogation unit after the interrogation unit receives this request signal when the response unit enters the communication.

The detecting means constantly detects moving bodies that enter the communication zone of the interrogation unit. If a detected image overlaps with the receiving area of the receiving device which has received and demodulated data, and a moving body in the receiving area on which the response unit is mounted has been photographed, it is determined that the moving body is a vehicle with which communication has been established. Conversely, a vehicle, which has passed by without being identified as a communicating vehicle, although detected as an image, is determined to be an unauthorized vehicle. In this way, unauthorized vehicles can be identified from the image data.

The data received by the receiving device is compared with data received by the interrogation unit, a receiving area is identified, and a moving body is identified. The moving body can therefore be identified with a high degree of certainty.

Receiving antennas are provided corresponding to a plurality of receiving areas. The entry position of a moving body can therefore be determined with a high degree of certainty depending on the nature of the signals received by the antennas.

A plurality of receiving areas can be covered by one receiving devices using beam control. A small number of antennas is therefore sufficient.

The receiving area of a receiving device is arranged to be wider at the entry point of a moving body than the communication zone of the interrogation unit. The area which the moving body enters forming part of the communication zone of interrogation unit is covered by the receiving area. Hence, the receiving device can definitely catch communication between the response unit and interrogation unit even when the speed of the moving body is very slow in the vicinity of the front edge of the communication zone from which the moving body enters (e.g. when the moving body is trapped in a traffic jam), and the position of the response unit can therefore be identified.

Furthermore, according to the present system having the above device for locating a moving body, the position of the response unit can be properly identified. Therefore, unauthorized vehicles can be identified, and a preferred fee collection system for a toll road can be obtained. According to these aspects, complicated control such as scanning of the communication zone in accordance with the moving body is not required. Furthermore, an unauthorized moving body which is not carrying a response unit is determined by using a detecting device.

DESCRIPTION OF THE PREFERRED EMBODIMENTS

Some embodiments of this invention will now be described in more detail with reference to the drawings.

Embodiment 1

Figure 1:
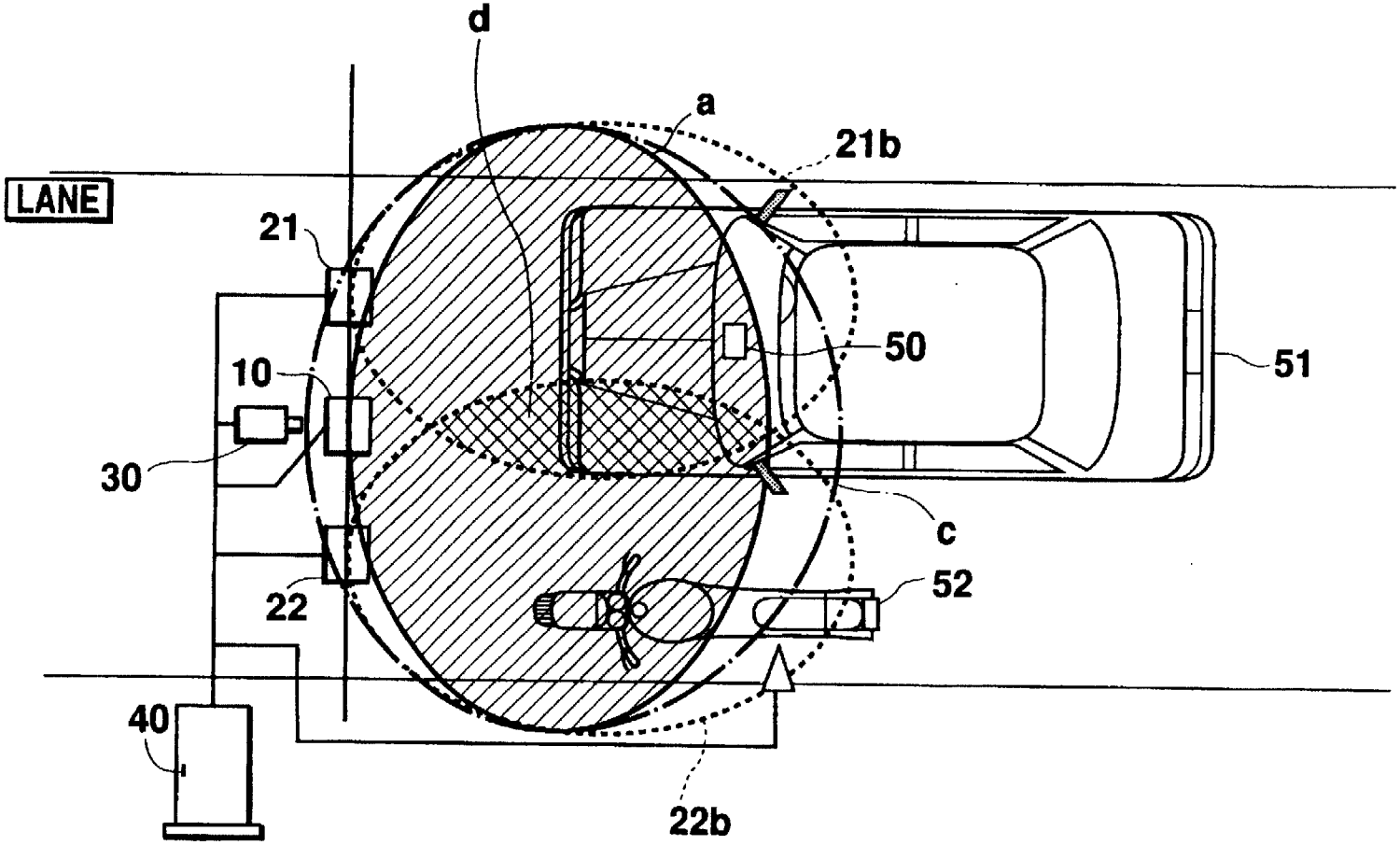
FIG. 1 is a plan view of component elements involved in one example when a communication zone is covered by providing a plurality of receiving antennas respectively corresponding to receiving areas.
Figure 2:
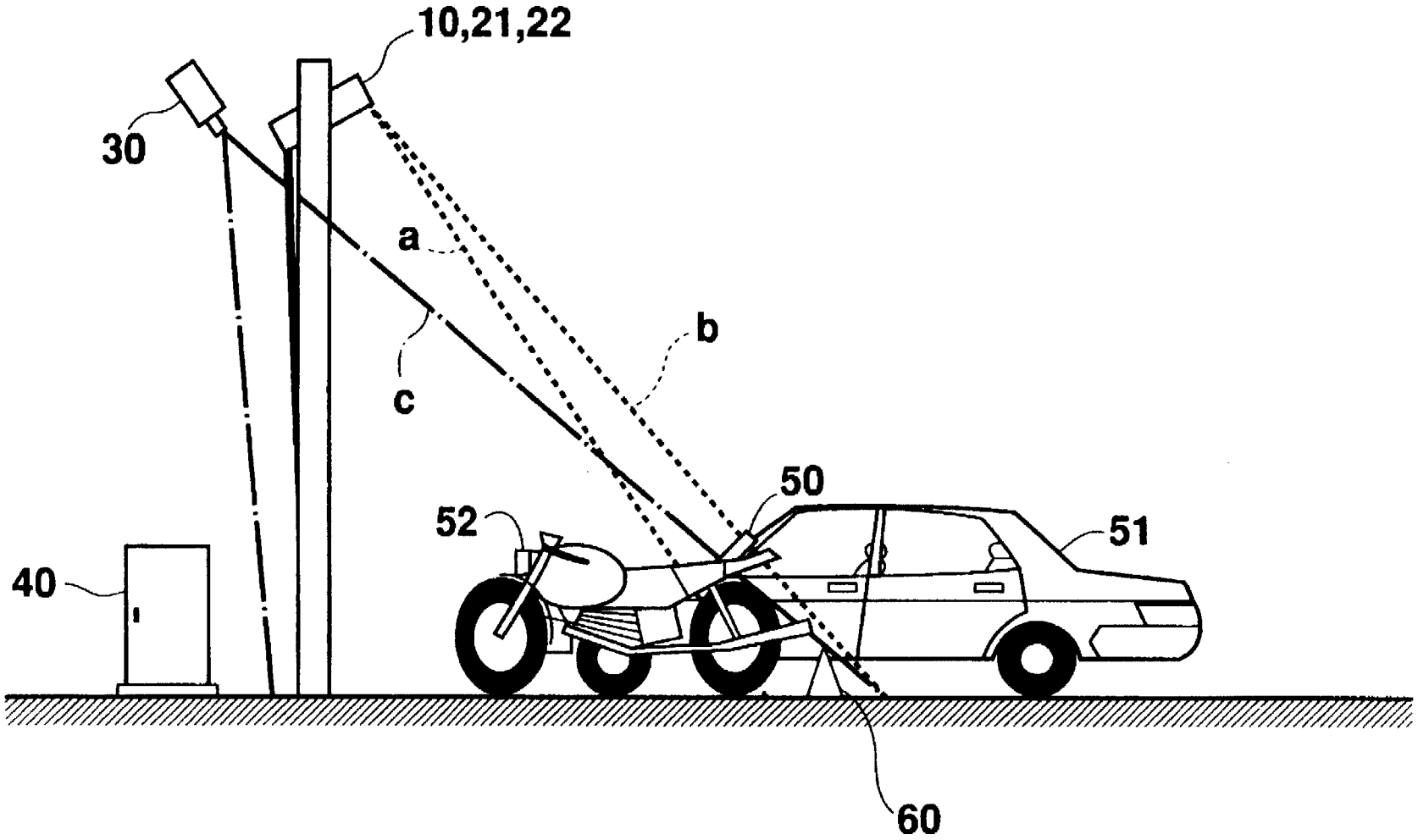
FIG. 2 is a lateral view of the component elements involved in one example when a communication zone is covered by providing a plurality of receiving antennas respectively corresponding to receiving areas.

First, an embodiment will be described wherein this invention is applied to a device for identifying a vehicle traveling in a vehicle lane (travel lane) as a predetermined moving area. As shown in FIG. 1 and FIG. 2, according to the first embodiment, a response unit 50 mounted on a vehicle 51 that has entered the communication zone "a" of an interrogation unit 10 disposed in the fixed part of the system, performs two-way data communication. The interrogation unit 10 covers at least one lane in the direction of the lane width, and is so designed that it has a communication zone "a" (shown by a solid line in the figures) of such a size that two or more vehicles can not enter it simultaneously in the travel direction of the lane.

Receiving antennas 21, 22 are so designed that they have a narrow receiving area "b" (shown by a broken line in the figures) of such a size that two or more vehicles can not enter it simultaneously in the width direction of the lane, the communication zone "a" being covered by a combination of these receiving areas "b". In this embodiment, the communication zone "a" of the interrogation unit 10 is covered by the receiving area "b" of the two receiving antennas 21, 22.

Figure 3A:
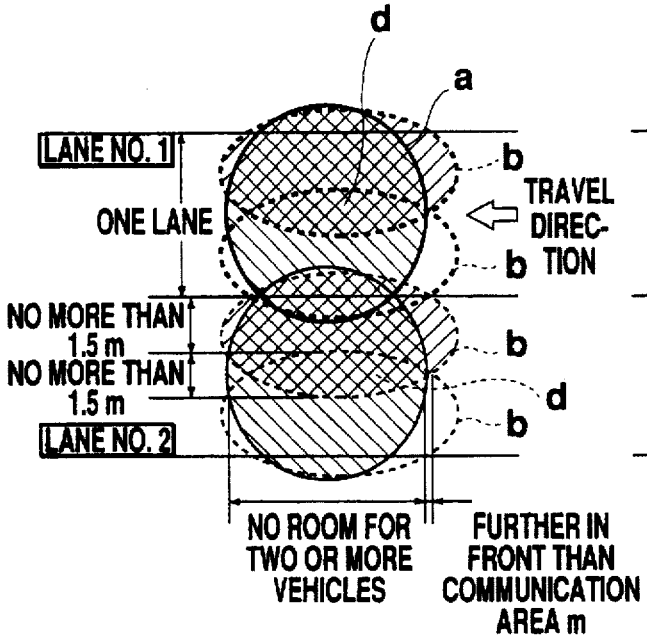
FIG. 3(A) is a descriptive view showing how a communication zone is covered by receiving areas of a receiving antenna when there is no division in the travel direction and there is overlap of receiving areas.
Figure 3B:
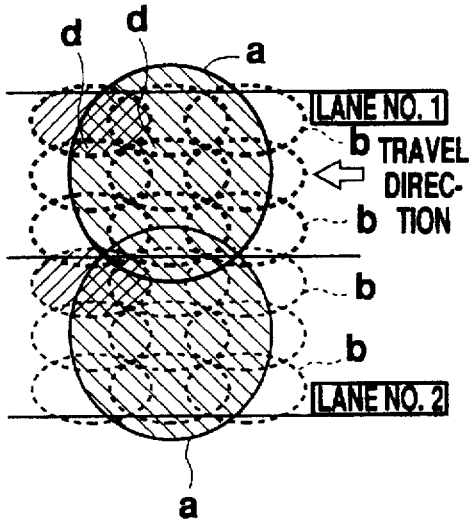
FIG. 3(B) is a descriptive view showing how a communication zone is covered by receiving areas of a receiving antenna when there is a division in the travel direction and there is overlap of receiving areas.

The receiving areas "b" may be combined according to any one of three arrangements, i.e. the communication zone "a" may be covered by dividing the receiving area into a plurality of areas in the width direction (perpendicular to the direction of travel) which are respectively arranged so as to overlap the receiving areas "b" as in FIG. 3(A), or the communication zone "a" may be covered by further dividing it in the travel direction as in FIG. 3(B), or it may be covered by arranging that the plurality of receiving areas do not overlap leaving gaps between them. Any of these arrangements may be used.

In any of these arrangements, it is desirable to set the width of the receiving area not to exceed 1.5 m so that two or more moving bodies can not occupy the area alongside one another. Further, the size of the communication zone "a" of the interrogation unit 10 in the vehicle travel direction is set so that there is no room for two vehicles to enter it.

Figure 3C:
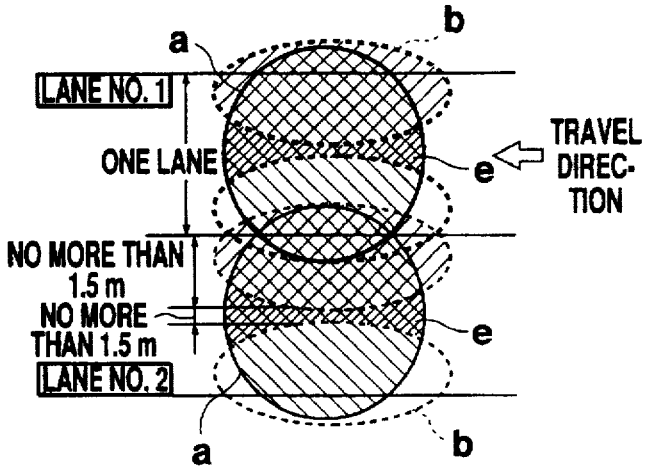
FIG. 3(C) is a descriptive view showing how a communication zone is covered by receiving areas of a receiving antenna when there is no division in the travel direction and there is no overlap of receiving areas.
Figure 4:
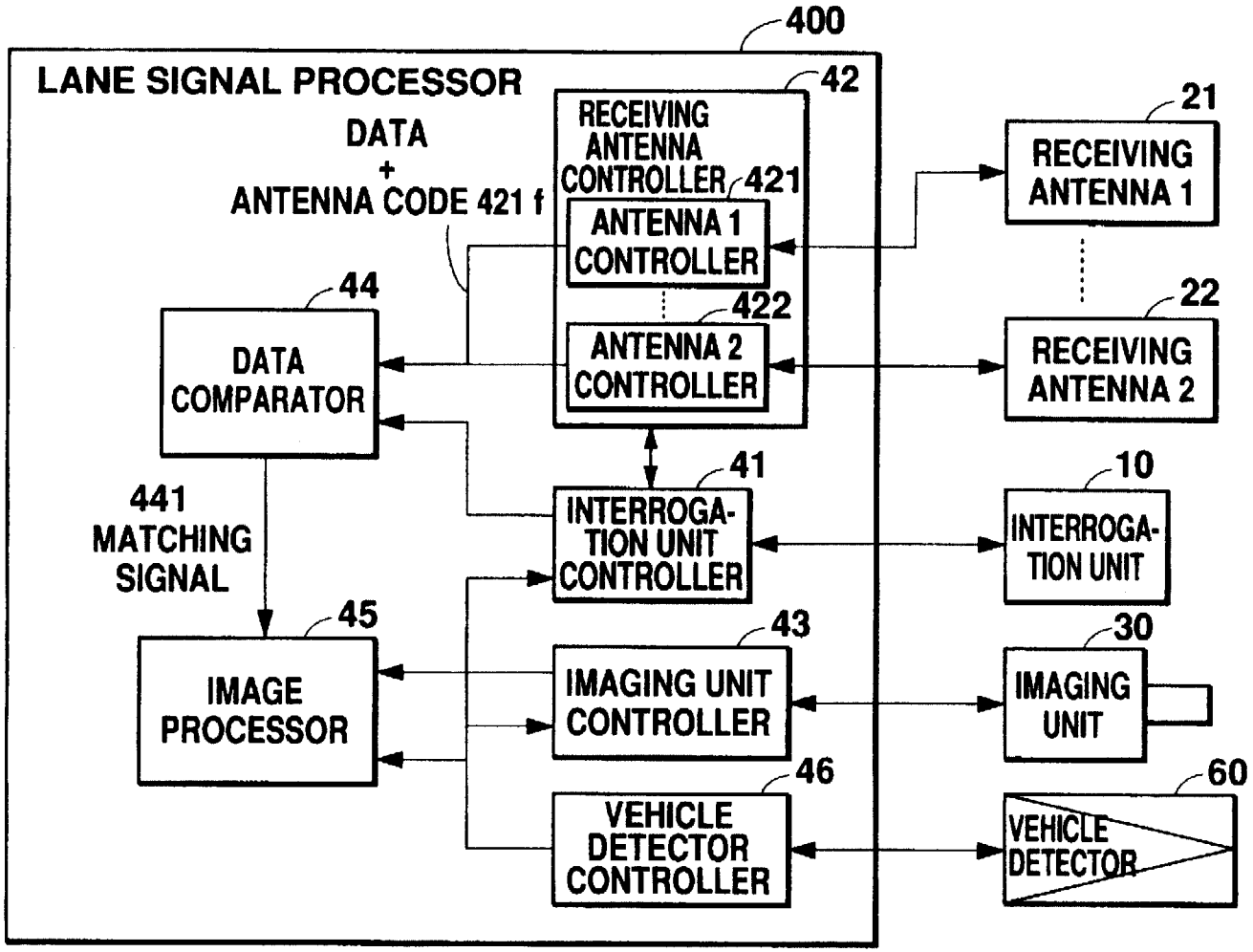
FIG. 4 is a schematic view of a lane signal processor when a plurality of receiving antennas are used.
Figure 5:
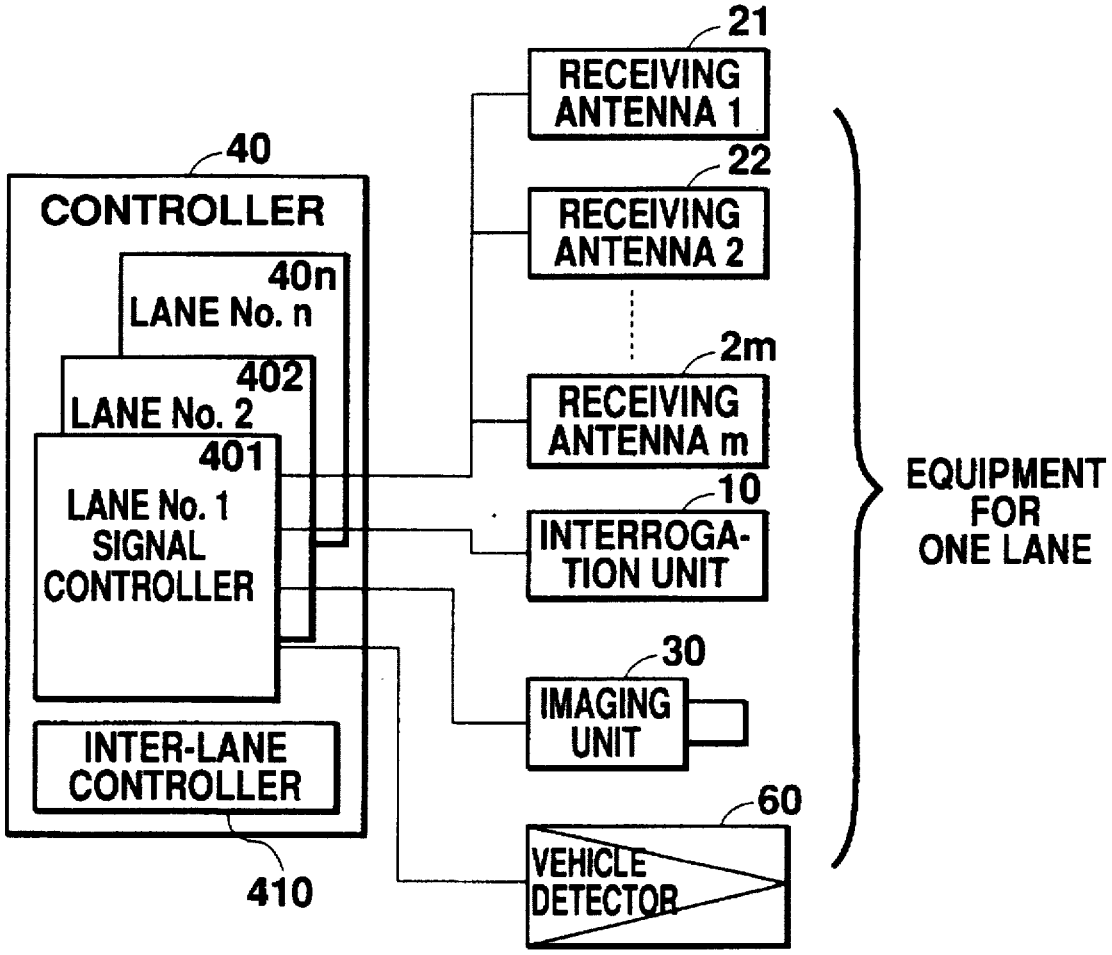
FIG. 5 is a schematic view of a system when a plurality of receiving antennas are used.

In the case of FIG. 3(C), communication zones "e" which cannot be covered by the receiving areas "b" of the receiving antennas 21, 22, exist within the communication zone "a" of the interrogation unit 10, the width of the areas "e" being set to be not more than 1.5 m.

Further, in any of the systems shown in FIG. 3(A), 3(B), and 3(C), the receiving area "b" of the receiving antennas 21, 22 is set to be wider than the communication zone "a" of the interrogation unit 10 (before the vehicle enters the communication zone "a").

Otherwise (that is, if the receiving area "b" is not set to be wider), there is a possibility that the response unit may be within the communication zone, but it is still outside the receiving area 21*b*, 22*b*. In such case, the response signal of the response unit is not received by the receiving antennas 21, 22, and thus the moving body cannot be located.

In general, the communication zones "a" and "b" of the interrogation unit 10 and receiving antennas 21, 22 depend on changes of antenna sensitivity due to temperature and voltage variations, and their magnitudes change accordingly. Therefore, when the receiving areas are arranged to overlap as in FIG. 3(A), or FIG. 3(B), the setting must not allow gaps to occur even if the receiving areas change due to variations in environmental conditions such as temperature or voltage. When gaps are left between receiving areas as in FIG. 3(C), the setting is such that overlaps are not produced by changes in the receiving areas due to environmental conditions such as temperature or voltage when they did not overlap initially.

The imaging device 30, which functions as detecting means, captures images of vehicles 51, 52 which have entered the communication zone "a", and it is provided with a CCD (Charge Coupled Device) camera or the like. The area set by the imaging device 30 (imaging area "c") is such that all vehicles within the communication zone "a" are captured on the screen of the device. It is not necessary, however, to accomplish this by using one imaging device, and it may be achieved instead by a plurality of imaging devices.

The interrogation unit 10, receiving antennas 21, 22 and imaging device 30 in the fixed part of the system are respectively connected to a controller 40 installed on the road.

This controller 40 comprises lane signal processors 401, 402 . . . , 40*n* (represented collectively hereinafter as a lane signal processor 400) which process signals from devices in the fixed part of the system and control operations for each lane, and an inter-lane controller 410 that coordinates operations between the lanes. The roadside devices for each lane are connected to the lane signal processor 400.

The interrogation unit 10 is connected to an interrogation unit controller 41, the imaging device 30 is connected to an imaging device controller 43, and the receiving antennas 21, 22 are respectively connected to corresponding antenna controllers 421, 422 on a receiving antenna controller 42. The interrogation unit controller 41 is connected to the antenna controller 42, and the receiving antennas 21, 22 are controlled so that they are in synchronism with the interrogation unit 10.

The outputs of the interrogation unit controller 41 and antenna controllers 421, 422 are respectively fed to a data comparator 44. In this data comparator 44, data obtained by the interrogation unit controller 41 is compared with data obtained by the antenna controllers 421, 422, and it is determined whether or not the data match.

The output of the data comparator 44 is connected to an image processor 45, and when the data obtained by the data comparator 44 match, a matching signal 441 is supplied to the image processor. According to this embodiment, a vehicle detector 60 that detects the entry of a vehicle into the communications area a is provided, a vehicle detector controller 46 is built into the lane signal processor 400, and these two devices are connected. The entry of a vehicle is recognized by the vehicle detector controller 46. The output of the vehicle detector controller 46 is fed to the interrogation unit controller 41, imaging device controller 43 and image processor 45, and is used as a control start timing signal. As shown in FIG. 2, a comparatively simple detector, such as a device which detects the obstruction of light by an object, can be used as the vehicle detector 60. The vehicle detector may also be an ultrasonic detector or a radio wave detector.

When the vehicle detector 60 is not used, the interrogation unit 10 alternately transmits a start-up signal 100 which is continuously transmitted even when no vehicle has entered the communication zone "a", and a CW 110 for receiving a start-up response signal 130 from the response unit 50. The receiving antenna controller 42, imaging device controller and image processor 45 operate in conjunction with each other.

Figure 6A:
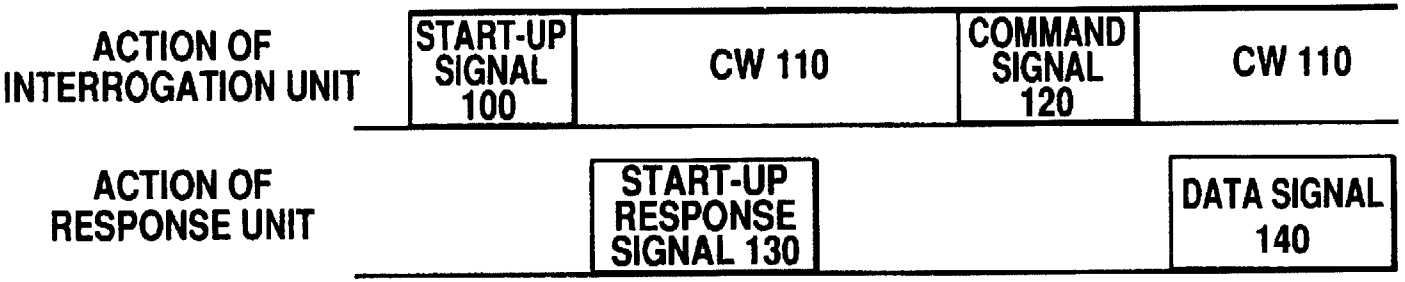
FIG. 6(A) is a timing chart showing a communication protocol when there is passive communication between an interrogation unit and a response unit.

The operation of the first embodiment will now be described. Referring to FIG. 1, the case will be described where a vehicle 51 carrying the response unit 50 enters the communication area "a" of the interrogation unit, and has entered the receiving area 21*b* of the receiving antenna The vehicle 51 is detected by the vehicle detector 60 as illustrated in FIG. 2, and an operation start signal is output by the vehicle detector controller 46 to the interrogation unit controller 41, imaging device controller 43 and image processor 45. The interrogation unit 10 which has received the operation start signal alternately transmits a start-up signal 100 to the response unit 50 and a CW 110 for receiving a start-up response signal 130 from the response unit 50, as shown in FIG. 6(A).

The response unit 50 which has received the start-up signal 100 modulates the CW 110 radiated by the interrogation unit 10 with its own data (identification code), and reflects the signal back to the interrogation unit 10 as the start-up response signal 130. The interrogation unit 10 which has received the start-up response signal 130 passes the received signal to the interrogation unit controller 41 and demodulates it, then transmits a command signal 120 followed by the CW 110 so as to exchange necessary data with the response unit 50. Transmission is referred to as "downlink", and reception as "uplink".

The start-up response signal 130 demodulated by the interrogation unit controller 41 and a data signal 140 are output to the data comparator 44.

The receiving antenna 21 receives the start-up response signal 130 and the data signal 140 both returned by the response unit 50, and data identical to the data demodulated by the interrogation unit controller 41 is demodulated by the antenna controller 421 of the receiving antenna controller 42. The antenna controller 42 supplies an antenna code **421*f* and the demodulated data signal to the data comparator 44. The data comparator 44 compares the data signal transmitted by the antenna controller 421 with a data signal transmitted by interrogation unit controller 41**. Both data signal contain at least information required to collect the toll fee, for example the ID code for identifying the vehicle, the vehicle size which is required to determine the fee, and information about the payer of the toll fee which is also required. In this embodiment, it is recognized that the response unit is within the communication zone when not all of the both data, but a part of both data. This information is temporarily stored in a memory, not shown, and transmitted to a CPU at a suitable timing. The fee is collected by an appropriate method such as bank debit or deduction from a prepaid tariff.

The data comparator 44 then transmits the matching signal 441 comprising the matching antenna code **421*f* to the image processor 45**.

The imaging device 30 is controlled by the image device controller 43, and when an operation start signal is supplied by the vehicle detector controller 46, it photographs an imaging region c. The photographed image data is sent to the image processor 45 via the image device controller 43. When there is a vehicle 51 that has entered the area, this is recorded in the image data. In the image processor 45, the receiving areas **21*b*, 22*b* of the receiving antennas 21, 22 are superposed on the image data for marking. When the matching signal 441 is input by the data comparator 44, the receiving area 21*b* corresponding to the antenna code 421*f* contained in the matching signal 441** is marked out.

If communications data is received by the receiving antenna 21, this means that the vehicle 51 carrying the response unit 50 should have at least been photographed in the receiving area **21*b*. The vehicle 51 photographed in the marked receiving area 21*b*** is therefore also marked, and identified as a vehicle with which communication was established.

This processing is performed by the image processor 45. Identification of vehicles by the image processor 45 can also be performed by relatively simple image processing such as the detection of moving bodies of a predetermined size.

When the response unit 50 is in an overlapping area "d" of the receiving areas **21*b*, 22*b*, data can be received by both the receiving antennas 21, 22. The matching signal 441 output by the data comparator 44 therefore comprises both antenna codes 421*f*, 422*f*. In this case, the overlapping area "d" of the receiving areas 21*b*, 22*b* is marked, and the vehicle 51** photographed in the area is also marked and identified as a communicating vehicle.

When the response unit 50 enters a communication zone "e" which is not covered by the receiving areas **21*b*, 22*b* arranged as shown in FIG. 3(C), communication with the interrogation unit 10 can still be established, but data cannot be received by the receiving antennas 21, 22. Data from the receiving antenna controller 42 and the antenna code "f" are therefore not input to the data comparator 44, but only data received from the interrogation unit controller 41 is input. The output of the data controller 44 then comprises a signal corresponding to the communication zone "e" instead of the antenna code "f" as the matching signal 441**.

Hence, when the response unit 50 is within the communication zone "e" of the interrogation unit 10 in the case of the arrangement of FIG. 3(C), it is not covered by the receiving areas **21*b*, 22*b* of the receiving antennas 21, 22. From the fact that communication with the interrogation unit 10 has been established, however, it is certain that the response unit 5O is inside the communication zone "e". The communication zone "e" is set so that it occurs at only one location in one vehicle lane, and the width of the zone is set to be no greater than 1.5 m so that a plurality of vehicles cannot enter it simultaneously. The response unit 50 can therefore be identified on the image photographed by the image device 30 as belonging to a vehicle in the communication zone "e" which is not covered by the receiving areas 21*b*, 22*b***.

As shown by FIG. 1, when an unauthorized vehicle 52 not carrying a response unit enters the area, the interrogation unit 10 and receiving antennas 21, 22 cannot receive the start-up response signal 130 and data signal 140 from the response unit 50. The data processor 45 therefore does not obtain the matching signal 441, and the receiving area is not marked on the screen data. The unauthorized vehicle 52 therefore passes through the imaging area c without being marked, and is identified as an unauthorized vehicle which remains unmarked on the photographic image.

When the two vehicles 51, 52 that have entered one communication zone both carry response units, separate antenna codes are recognized due to signals from the two receiving antennas 21, 22, and both vehicles are marked. Hence, even when the vehicle 51 carrying an ordinary response unit 50 and an unauthorized vehicle 52 which does not carry a response unit are simultaneously present in the communication zone "a" of the interrogation unit 10, they can be correctly identified as a communicating vehicle and an unauthorized vehicle.

Embodiment 2

Figure 7:
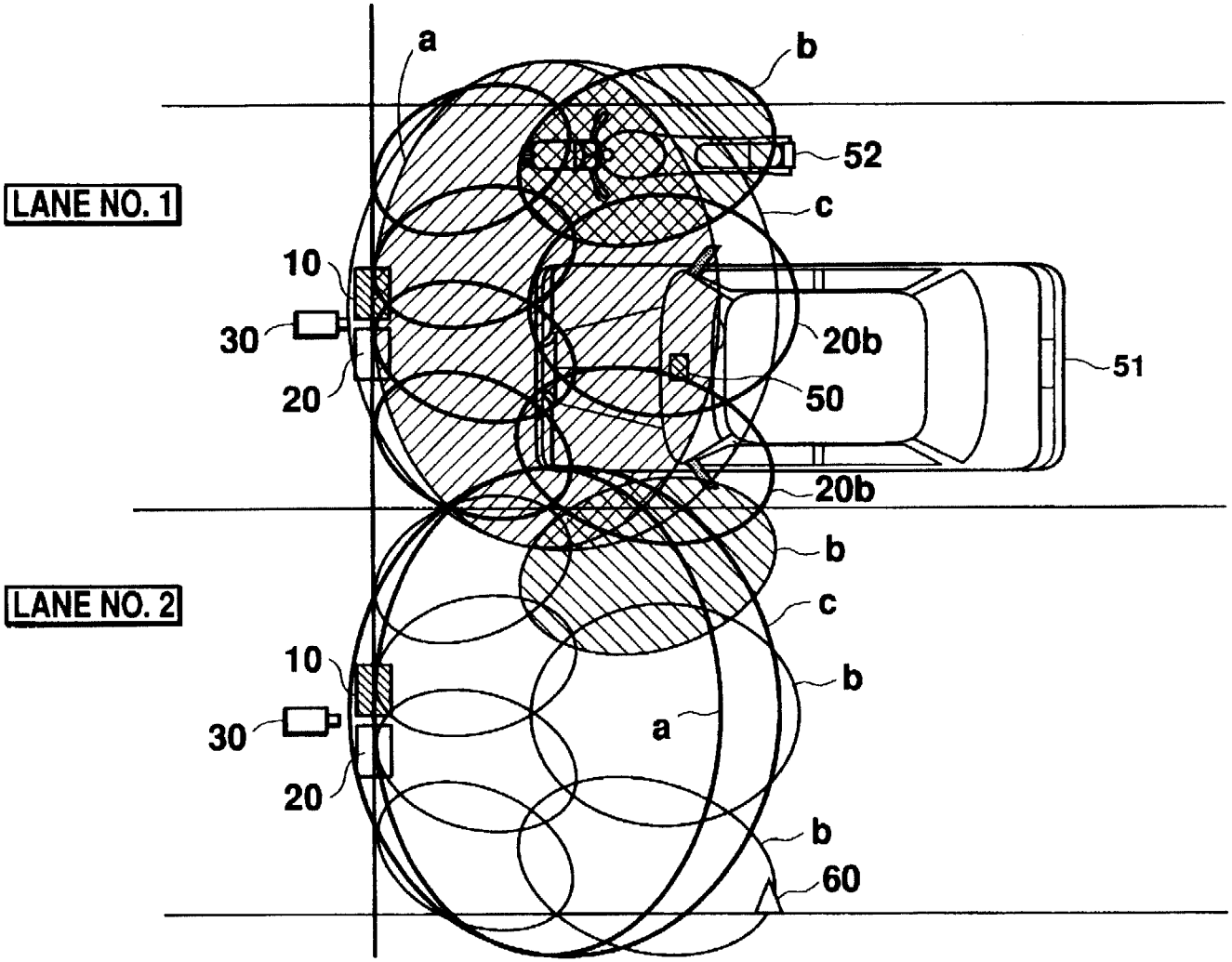
FIG. 7 is a plan view of component elements in one example when a beam control antenna, wherein the position of the receiving area can be changed by controlling the orientation of a directional beam, is provided to cover the communication zone.
Figure 8:
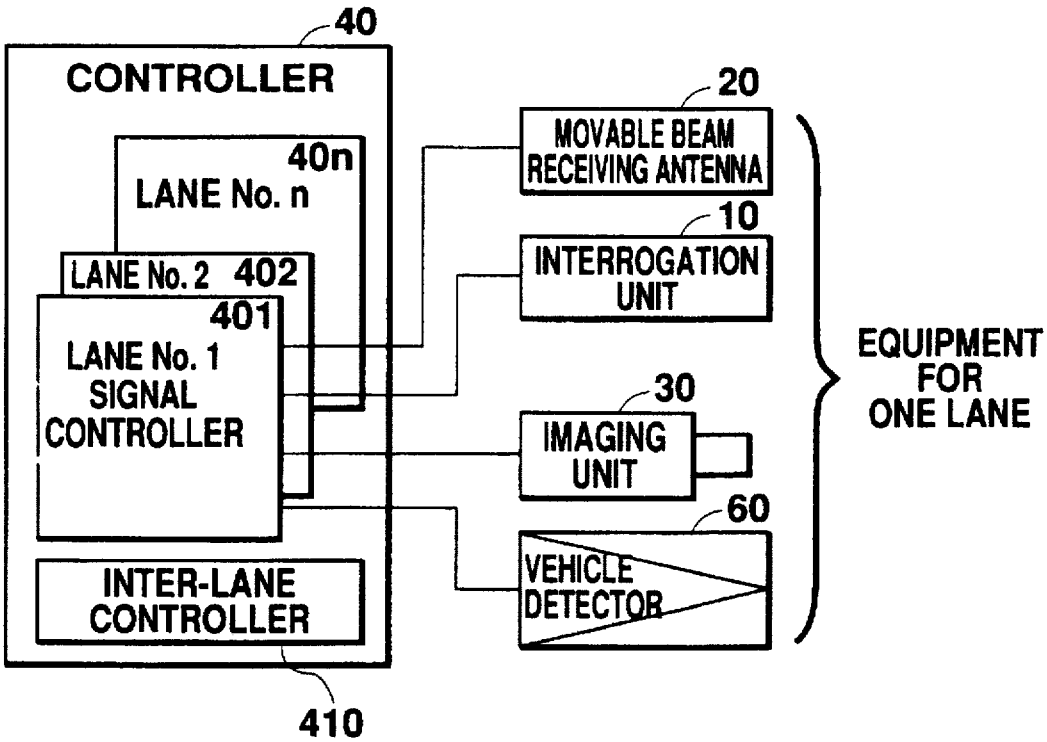
FIG. 8 is a schematic view of a system when a beam control receiving antenna is used.

Next, a second embodiment of this invention will be described. According to this embodiment, the plurality of receiving antennas 21, 22 of Embodiment 1 are replaced by one beam control receiving antenna 20 wherein the orientation of the beam is electronically controlled, as shown in FIG. 7 and FIG. 8.

Figure 9:
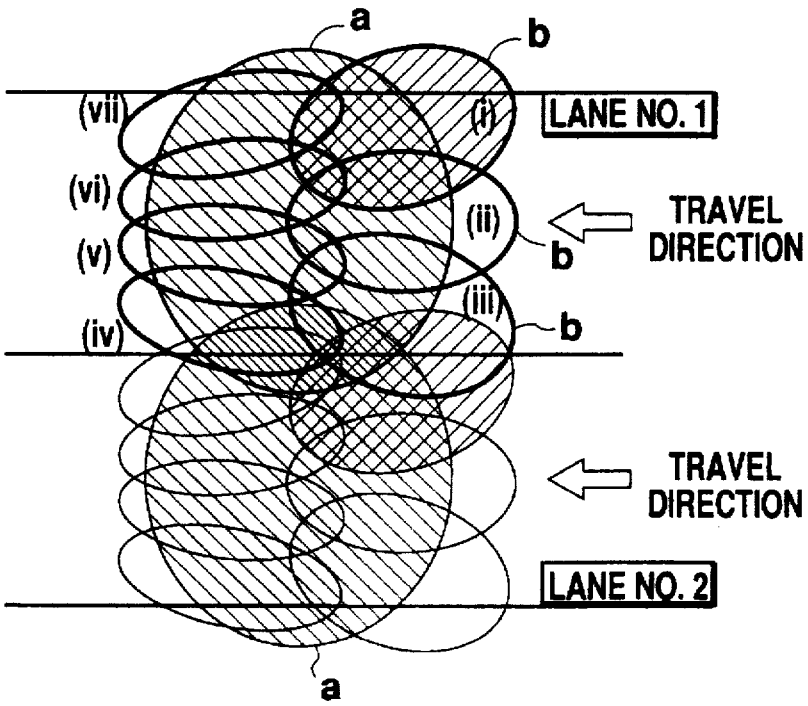
FIG. 9 is a descriptive diagram showing how a communication zone is covered by a receiving area of a receiving antenna.
Figure 10:
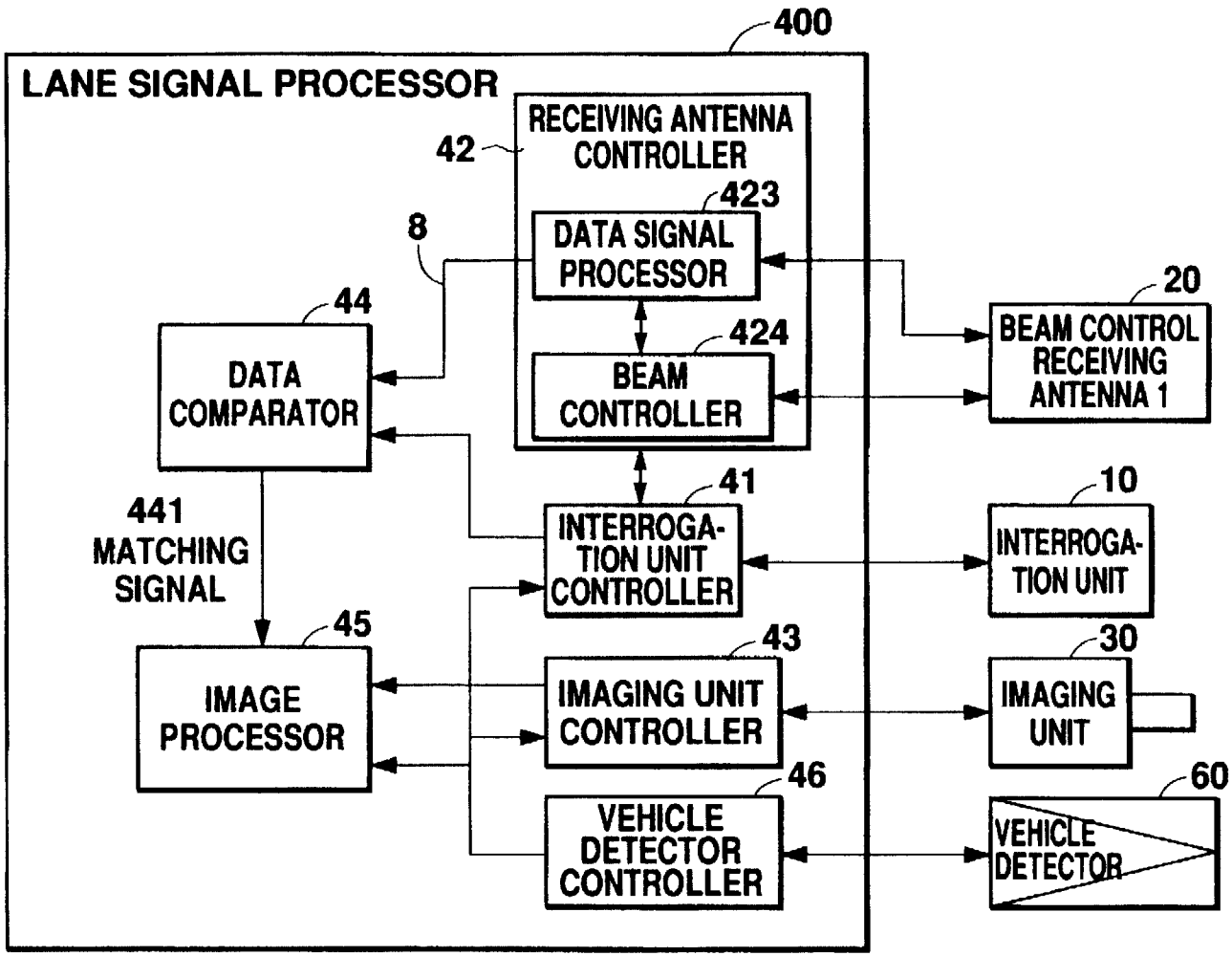
FIG. 10 is a schematic view of a lane signal processor when a beam control receiving antenna is used.

As shown in FIG. 9, the communication zone "a" of the interrogation unit 10 is covered by the narrow receiving area **20*b* of the beam control receiving antenna 20 so as to leave no gaps. In this case the receiving antenna controller 42, in addition to the data signal processor 423 which demodulates the start-up response signal 130 and data signal 140 returned from the response unit 50, comprises a beam controller 424 that controls the antenna beam direction of the beam control receiving antenna 20, and controls the position of the receiving area 20b, as shown in FIG. 10**.

The data signal processor 423 is interconnected with the beam controller 424, both these units being connected to the beam control receiving antenna 20. The output of the data signal processor 423 is also connected to the data comparator 44. The remaining features of the construction are identical to those of Embodiment 1.

The operation of Embodiment 2 will now be described, focussing mainly on those features which are different from Embodiment 1. When the vehicle 51 enters the communication zone "a" of the interrogation unit 10, it is detected by the vehicle detector 60, and the various parts of the controller 40 are then activated. While the interrogation unit 10 is transmitting the CW 110, the orientation of the beam of the beam control receiving antenna 20 is changed in steps based on the control signal from the beam controller 424 of the receiving antenna controller 42. For example, in order that the receiving area 20b to move in steps so as to cover the communication zone "a" without leaving any gaps, the beam is scanned in the order (i)-(ii)-(iii)-(iv)-(v)-(vi)-(vii) as shown in FIG. 9. When the receiving area 20b is controlled to a position which includes the response unit 50, the beam control receiving antenna 20 receives the start-up response signal 130 and data signal 140 returned by the response unit 50.

The data signal processor 423 demodulates the start-up response signal 130 and data signal 140. A beam position signal obtained from the beam control signal is then input from the beam controller 424 to the data signal processor 423, and this is output together with the demodulated received signal to the data comparator 44.

The data comparator 44 compares the two data input from the interrogation unit controller 41 and receiving antenna controller 42, and when data of at least a predetermined length match, a matching signal 441 comprising the beam position signal is transmitted to the image processor 45.

The imaging device 30 is controlled by the imaging device controller 43, and photographs the imaging area "c" on an operation start-up signal. The resulting image data is transmitted to the image processor 45 via the imaging device controller 43. When a vehicle 51 has entered the area, the vehicle 51 which has been photographed on a marked receiving area 20b is also marked, and the vehicle is identified as a vehicle with which communication was established.

When a response unit 50 is present in an overlapping area "d" of adjacent receiving areas 20b of the beam receiving antenna, data can be received in both beam positions. The matching signal 441 output by the data comparator 44 therefore comprises a plurality of signals corresponding to adjacent beam positions. In this case, the image processor 45 marks the overlapping area "d" of the adjacent receiving areas 20b, the vehicle 51 which has been photographed is also marked on this area, and the vehicle is identified as an authorized vehicle.

In the case of an unauthorized vehicle 52 which is not carrying a response unit, the interrogation unit 10 and beam control antenna 20 cannot receive the start-up response signal 130 and data signal 140 from the response unit, so the image processor 45 cannot obtain the matching signal 441 and the receiving area is not marked on the image data. The unauthorized vehicle 52 therefore passes through the imaging area "c" without being marked, i.e. it is identified as an unauthorized vehicle which remains on the photographic image without being marked.

Hence, even when the vehicle 51 carrying an ordinary response unit 50 and an unauthorized vehicle 52 which does not carry a response unit are simultaneously present in the communication zone "a" of the interrogation unit 10, they can be correctly identified as a communicating vehicle and an unauthorized vehicle.

Other Embodiments

Figure 6B:
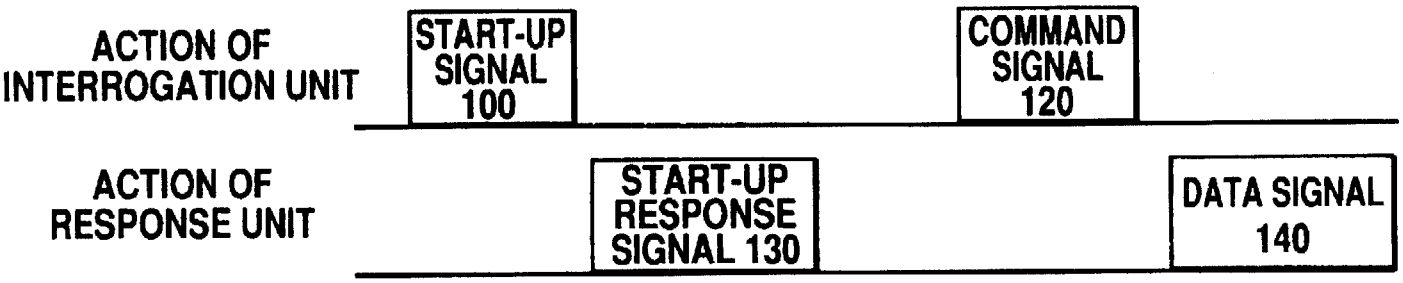
FIG. 6(B) is a timing chart showing a communication protocol when there is active communication between an interrogation unit and a response unit.

The aforesaid Embodiment 1 and Embodiment 2 were described assuming a passive moving body identifying device using a signal emanating from the interrogation unit for data communications with the response unit. In the case of an active system where the response unit is itself capable of emanating a signal as shown in FIG. 6(B), it is no longer necessary to transmit the CW 110 which was transmitted by the interrogation unit in order to receive response data from the response unit. The start-up response signal 130 and data signal 140 are therefore transmitted by the response unit itself to the interrogation unit. This, however, does not effect in any way the construction, operation or advantages offered by this invention.

What is claimed is:

1. A device for locating a moving body having a response unit, said device comprising:

an interrogation unit having a predetermined communication zone having a width which is perpendicular to a travel path of a moving body which allows a plurality of moving bodies to simultaneously exist in the communication zone, said interrogation unit transmitting a radio signal to said communication zone where said moving body having a response unit for receiving said radio signal passes;

a receiving device having a plurality of receiving areas at least in a direction perpendicular to the travel path of said moving body so as to cover said communication zone, said receiving device being capable of receiving distinguishably each signal from said plurality of receiving areas, each of said receiving areas having a size which allows only one moving body therein; and a processor for determining the position of said moving body in said communication zone based on a reception result of said receiving device.

2. A device as defined in claim 1, further comprising:

a detecting device for detecting said moving body when it enters said communication zone, thereby locating a plurality of said moving bodies in said communication zone based on a detection result thereof and the reception result of said receiving device, and recognizing the existence of an unauthorized moving body without a proper response unit based on the detection result thereof and based on non-existence of the reception result of said receiving device.

3. A device as defined in claim 1, wherein:

said interrogation unit further comprises a device for receiving a radio signal from said moving body, and said processor determines the position of said moving body based on both the reception result of said receiving device and a communication result in said interrogation unit.

4. A device as defined in claim 2, wherein:

said interrogation unit further comprises a device for receiving a radio signal from said moving body, and said processor determines the position of said moving body based on both the reception result of said receiving device and a communication result in said interrogation unit.

5. A device as defined in claim 4, wherein:

said detecting device is an imaging device that photographs said moving body, and said processor comprises a comparator circuit that compares receiving data of said receiving device and receiving data of said interrogation unit in order to locate a receiving area where said response unit exists, and an image processing circuit that determines whether or not said moving body is carrying a proper response unit based on a signal output by said comparator and an image signal from said imaging device.

6. A device as defined in claim 5 wherein said interrogation unit transmits a CW signal, and said interrogation unit and receiving device receive a modulated wave of a CW signal reflected by said response unit.

7. A device as defined in claim 1 wherein said receiving device comprises a plurality of receiving antennas respectively corresponding to said plurality of receiving areas.

8. A device as defined in claim 1 wherein said receiving device comprises a beam control antenna that receives a signal from each receiving area by controlling the orientation of a directional beam.

9. A device as defined in claim 1 wherein:

said receiving area of said receiving device is set to be wider than said communication zone on a side thereof from which said moving body enters said zone.

10. A system having a device installed on a road for determining whether a vehicle traveling on said road is carrying a predetermined response unit, said device comprising:

an interrogation unit having a predetermined communication zone having a width which is perpendicular to a travel path of the vehicle which allows a plurality of vehicles to simultaneously exist in the communication zone, said interrogation unit transmitting a radio signal to said communication zone where a response unit for receiving said signal passes;

a receiving device having a plurality of areas at least in a direction perpendicular to said road so as to cover said communicating zone, said device being capable of receiving distinguishably each signal from said plurality of receiving areas, each of said plurality of areas having a size which is capable of having only one vehicle therein; and a processor for determining the position of said vehicle carrying the response unit based on the reception result of said receiving device.

11. A system as identified in claim 10, wherein said device further comprises a detecting device that detects said vehicle when it enters said communication zone.

12. A system as defined in claim 11 for a fee collection system for a toll road, comprising said interrogation unit, said receiving device, said processor and said detecting device, whereby information about said vehicle is obtained for collecting a fee based on the reception result from said response unit.

13. A device according to claim 1, wherein:

said receiving device is a receive only device, and said receiving areas are receive only areas.

14. A device according to claim 1, wherein:

said receiving areas are each smaller than said communication zone.

15. A device according to claim 1, wherein:

said receiving areas partially overlap each other.

16. A device according to claim 1, wherein:

said interrogation unit communicates simultaneously with a plurality of moving bodies which are in different receiving areas and in a same communication zone.

17. A system according to claim 10, wherein:

said receiving device is a receive only device, and said areas are receive only areas.

18. A system according to claim 10, wherein:

said areas are each smaller than said communication zone.

19. A system according to claim 10, wherein:

said areas partially overlap each other.

20. A system according to claim 10, wherein:

said interrogation unit communicates simultaneously with a plurality of vehicles which are in different receiving areas and in a same communication zone.

* * * * *